US006748189B2

(12) United States Patent
Vejtasa et al.

(10) Patent No.: US 6,748,189 B2
(45) Date of Patent: Jun. 8, 2004

(54) SYSTEM AND METHOD FOR EXTRACTING CARRIER LIQUID

(75) Inventors: David S. Vejtasa, Springfield, MO (US); Christopher A. Schantz, Redwood City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/269,469

(22) Filed: Oct. 11, 2002

(65) Prior Publication Data

US 2004/0071480 A1 Apr. 15, 2004

(51) Int. Cl.[7] ..... G03G 15/10
(52) U.S. Cl. ..... 399/250; 399/251
(58) Field of Search ..... 399/250, 251, 399/237

(56) References Cited

U.S. PATENT DOCUMENTS

| | | | | | |
|---|---|---|---|---|---|
| 5,557,376 | A | | 9/1996 | Landa et al. | |
| 5,592,269 | A | | 1/1997 | Younes et al. | |
| 6,085,055 | A | * | 7/2000 | Shin et al. | 399/250 |
| 6,442,363 | B2 | * | 8/2002 | Chae et al. | 399/237 |
| 6,493,531 | B2 | * | 12/2002 | Choi | 399/251 |
| 6,496,674 | B2 | * | 12/2002 | Pang et al. | 399/250 |
| 2002/0028090 | A1 | * | 3/2002 | Shin et al. | 399/251 |

* cited by examiner

*Primary Examiner*—Sophia S. Chen

(57) ABSTRACT

A system and method for extracting carrier liquid utilizes thermal energy generated above a surface from which the carrier liquid is being extracted. The thermal energy can be generated by a heating element positioned over the surface. The thermal energy is used to evaporate the carrier liquid on the surface so that the evaporated carrier liquid can be condensed for collection.

20 Claims, 5 Drawing Sheets

SYSTEM AND METHOD FOR EXTRACTING CARRIER LIQUID

FIELD OF THE INVENTION

The invention relates generally to liquid extraction, and more particularly to a system and method for extracting carrier liquid.

BACKGROUND OF THE INVENTION

In an electrostatic imaging process, a copy of an original image is produced by forming a toner image from a latent electrostatic image, which is then transferred to a target substrate, such as paper. The latent electrostatic image is generated by initially charging a photoconductor to create a uniform electrostatic charge of a particular polarity over the surface of the photoconductor. As an example, the photoconductor can be charged by exposing the surface of the photoconductor to a charge corona. The uniformly charged surface of the photoconductor is then patterned by selectively directing a modulated beam of light, such as a beam of laser light, to form the latent electrostatic image. Using charged toner particles having opposite polarity of the photoconductor surface, the latent electrostatic image is developed into the toner image by applying the charged toner particles to the photoconductor surface, which selectively adhere to the photoconductor surface according to the latent electrostatic image.

There are two distinct types of electrostatic imaging machines. The first type of electrostatic imaging machines uses dry toner to form toner images. The second type of electrostatic imaging machines uses liquid toner to form the toner images. Liquid toner generally includes toner particles and charge director compounds that are dispersed in a dielectric hydrocarbon-based carrier liquid, such as hydrocarbon solvents sold under the name of ISOPAR, which is a trademark of the Exxon Corporation. The liquid toner may be formed within the machine by mixing concentrated toner solvent, charge director compounds and dielectric hydrocarbon-based carrier liquid.

Some electrostatic imaging machines that use liquid toner utilize an intermediate transfer media (ITM) drum to transfer toner images from the photoconductor to a target substrate. The ITM drum includes a blanket on the surface on the ITM drum, which is a material that allows the ITM drum to accept a toner image and to transfer the toner image to the target substrate. In these electrostatic imaging machines, after the toner image is transferred onto the blanket of the ITM drum, the carrier liquid of the toner image is typically extracted from the surface of the ITM blanket by a carrier liquid extraction system. A conventional carrier liquid extraction system includes one or more heating elements, a suction plenum and a condenser. The heating elements are located within the ITM drum, while the suction plenum and the condenser are located outside of the ITM drum. In operation, the heating elements increase the temperature of the ITM blanket, which evaporates the carrier liquid on the ITM blanket. The evaporated carrier liquid is drawn into suction plenum using pressure differences created by the suction plenum. The evaporated carrier liquid is then condensed by the condenser so that the carrier liquid can be collected for disposal.

A concern with the conventional carrier liquid extraction system is that the use of heating elements in the ITM drum to evaporate carrier liquid is not efficient with respect to power consumption. In addition, during an unexpected shutdown, the internally heated ITM drum may damage the ITM blanket due to post-shutdown increase in blanket temperature caused by the latent heat of the heating elements combined with the temperature differential between the heating elements, the inside of the drum and the outside of the drum during normal operation. Another concern is that some of evaporated carrier liquid, which is considered hazardous material, is not drawn into the suction plenum of the carrier liquid extraction system. Consequently, a significant amount of carrier liquid is released into the surrounding environment exposing operators, technicians and other personnel to the hazardous material.

In view of these concerns, there is a need for a system and method for extracting carrier liquid in an efficient manner such that power consumption is reduced and the amount of carrier liquid released into the surrounding environment is minimized without causing damage to heat sensitive components, such as the ITM blanket.

SUMMARY OF THE INVENTION

A system and method for extracting carrier liquid utilizes thermal energy generated above a surface from which the carrier liquid is being extracted. The thermal energy can be generated by a heating element positioned over the surface. The thermal energy is used to evaporate the carrier liquid on the surface so that the evaporated carrier liquid can be condensed for collection. The use of thermal energy generated above the surface allows the system to evaporate the carrier liquid in an efficient manner with respect to power consumption. In an embodiment, the heating element may be included in a housing structure along with a condenser so that these components can be packaged in a compact assembly, which may be included in an electrostatic imaging machine. The configuration of these components allows the system to reduce the amount of evaporated carrier liquid released into the surrounding environment.

A system for extracting carrier liquid in accordance with the invention includes an imaging component, a heating element and a condenser. The imaging component has a surface to receive the carrier liquid. The heating element, which can be positioned over the surface of the imaging component, is configured to generate thermal energy that is to evaporate the carrier liquid on the surface of the imaging component. The condenser is configured to condense the evaporated carrier liquid from the surface of the imaging component.

In an embodiment, the heating element and the condenser are operatively connected to a housing structure, which is configured to be positioned over the surface of the imaging component.

A method for extracting carrier liquid includes providing a surface with the carrier liquid, generating thermal energy above the surface, evaporating the carrier liquid on the surface using the thermal energy, and condensing the evaporated carrier liquid from the surface.

Other aspects and advantages of the present invention will become apparent from the following detailed description, taken in conjunction with the accompanying drawings, illustrated by way of example of the principles of the invention.

DETAILED DESCRIPTION

Figure 1:
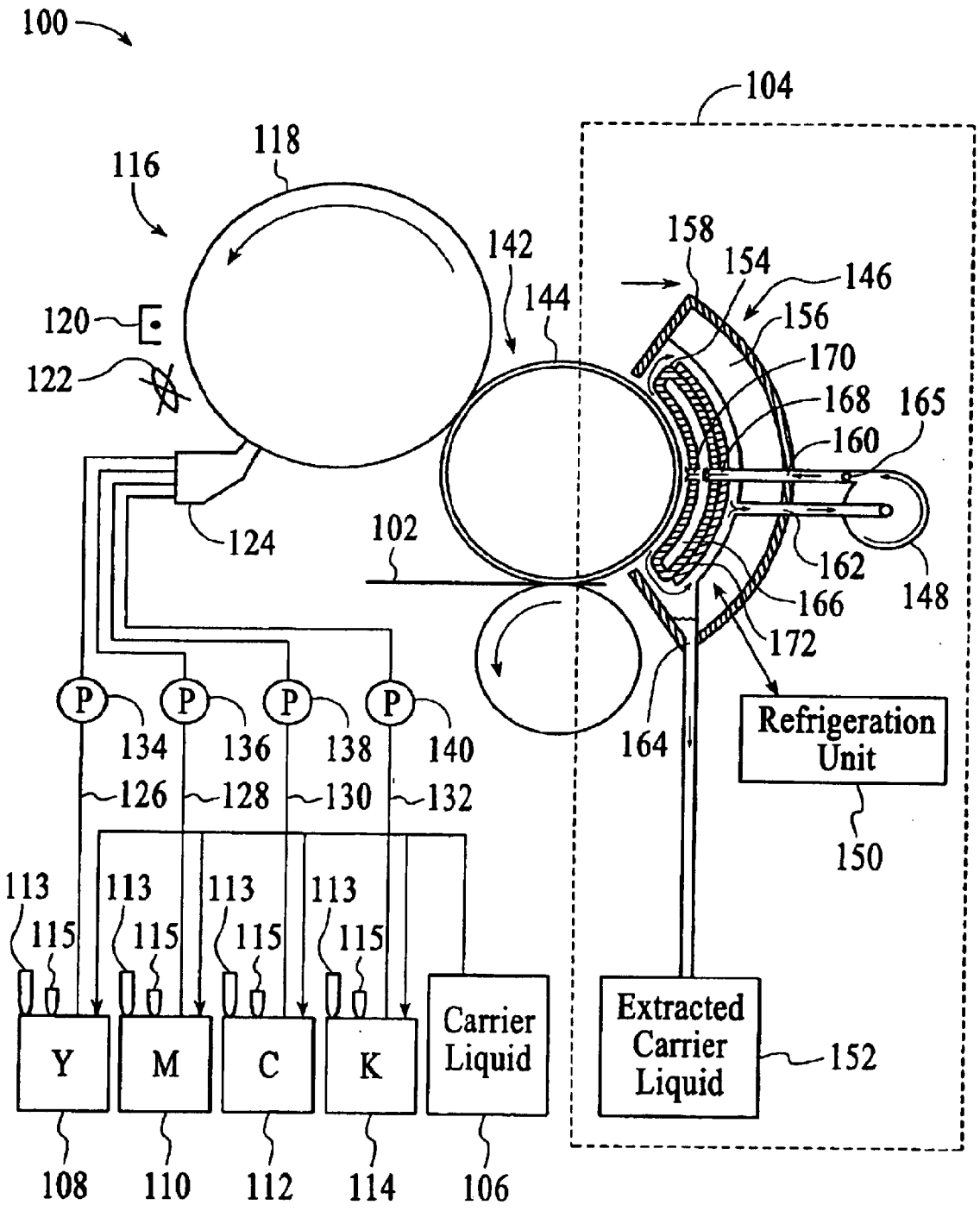
FIG. 1 is a diagram of one embodiment of an electrostatic imaging machine in accordance with the present invention.

With reference to FIG. 1, an electrostatic imaging machine 100 in accordance with one embodiment of the invention is shown. The electrostatic imaging machine operates to print a replicate color image of an original image onto a target substrate 102, e.g., a sheet of paper, using liquid toners of different colors, which include carrier liquid. The carrier liquid may be any hydrocarbon-based liquid having a resistivity value suitable for electrostatic imaging process. In the exemplary embodiment, the carrier liquid is a hydrocarbon-based liquid commercially available under the name ISOPAR, which is a trademark of the Exxon Corporation. The electrostatic imaging machine includes a carrier liquid extraction system 104, which operates to extract carrier liquid from toner images generated using the liquid toners.

As shown in FIG. 1, the electrostatic imaging machine 100 further includes a carrier liquid supply receptacle 106 and liquid toner receptacles 108, 110, 112 and 114. The carrier liquid supply receptacle 106 is used to hold new carrier liquid that is used to form different color liquid toners. The liquid toner receptacles 108–114 are used to hold individual color liquid toners. As indicated in FIG. 1, the liquid toner receptacles may be used to hold liquid toners for yellow (Y), magenta (M), cyan (C) and Black (K). However, the liquid toner receptacles may be used to hold liquid toners of different colors. Each of the color liquid toners is a mixture of concentrated toner, charge director compounds, and carrier liquid. Thus, each liquid toner receptacle is connected to a corresponding concentrated toner container 113 and a charge director container 115 to receive the respective concentrated toner and charge director compounds. The liquid toner receptacles are also connected to the carrier liquid supply receptacle 106 to receive fresh carrier liquid.

The electrostatic imaging machine 100 also includes an imaging drum 116 having a photoconductor surface 118. The photoconductor surface of the imaging drum is used to generate latent electrostatic image, which are formed into toner images. The electrostatic imaging machine further includes a photoconductor charging device 120, an optical imaging device 122, and a multi-color toner spray assembly 124, which are operatively associated with the imaging drum 116 to generate the latent electrostatic and toner images. The photoconductor charging device 120 operates to uniformly charge the photoconductor surface of the imaging drum with a charge of a particular polarity. As an example, the photoconductor charging device may be a corona discharge device. The optical imaging device 122 operates to create a latent electrostatic image on the charged photoconductor surface by selectively discharging portions of the charged photoconductor surface according to the original image to be replicated. As an example, the optical imaging device may be a laser scanner, an ionographic imaging device or an optical projection device. The multi-color toner spray assembly 124 operates to selectively provide different color liquid toners from the liquid toner receptacles 108–114 to the photoconductor surface. Thus, the multi-color toner spray assembly is connected to the liquid toner receptacles via conduits 126, 128, 130 and 132. Along these conduits are the pumps 134, 136, 138 and 140 to pump the different color liquid toners from the liquid toner receptacles to the multi-color toner spray assembly through the respective conduits.

The electrostatic imaging system 100 also includes an intermediate transfer media (ITM) drum 142 positioned to engage the photoconductor surface 118 of the imaging drum 116, as illustrated in FIG. 1. The ITM drum operates to transfer the toner image on the photoconductor surface of the imaging drum to the target substrate 102. Depending on the operational configuration of the electrostatic imaging system, the ITM drum may sequentially transfer toner images of different colors to the target substrate to form a color image on the target substrate. That is, each toner image of a particular color is generated and transferred to the target substrate through the intermediate transfer member. Alternatively, the ITM drum may collectively transfer toner images of different colors to the target substrate as a color composite toner image. In this configuration, each toner image of a particular color is sequentially transferred to the ITM drum to form a color composite toner image on the ITM drum. The color composite toner image is then transferred to the target substrate to form a color image on the target substrate.

The ITM drum 142 of the electrostatic imaging machine 100 is covered with an ITM blanket 144, which is formed of a material that is able to accept toner images so that the ITM drum can transfer the toner images from the imaging drum 116 to the target substrate 102. In addition, the material of the ITM blanket allows the ITM blanket to evaporate the carrier liquid of the toner image on the ITM blanket when the ITM blanket is heated. Consequently, the ITM blanket allows the carrier liquid extraction system 104 to extract carrier liquid from the ITM drum by heating the ITM blanket, as described in more detail below.

The carrier liquid extraction system 104 of the electrostatic imaging machine 100 operates to extract carrier liquid from the ITM drum 142 by evaporating the carrier liquid on the ITM blanket 144 and then condensing the evaporated carrier liquid. The carrier liquid extraction system includes a thermal shoe assembly 146, a circulation blower 148, a refrigeration unit 150 and a carrier liquid receiving receptacle 152. The thermal shoe assembly 146 in conjunction with the circulation blower 148 and the refrigeration unit 150 evaporates and condenses the carrier liquid from the ITM blanket. The condensed carrier liquid is then drained into the carrier liquid receiving receptacle 152. The extracted carrier liquid can then be collected for disposal or recycling.

The thermal shoe assembly 146 includes a heating element 154 and a condenser 156, which are contained within a housing structure 158. The housing structure 158 has an air intake 160 and an air outtake 162 that are connected to the circulation blower 148, which provide circulating gaseous material, e.g., air, through the housing structure. The housing structure also includes a drain 164, which leads to the carrier liquid receiving receptacle 152. The thermal shoe assembly is designed to be positioned in close proximity to the surface of the ITM blanket 144 during operating, as shown in FIG. 1. As an example, when the thermal shoe assembly is engaged with the ITM drum, the distance between the housing structure and the ITM blanket can be between 0.1 to 1 mm. Thus, when the thermal shoe assembly is engaged with the ITM drum, the housing structure provides a substantially enclosed environment. Consequently, most of the air circulated through the thermal shoe assembly by the circulation blower 148 is contained within the thermal shoe assembly when the thermal shoe assembly is engaged with the ITM drum. Similarly, most of the evaporated carrier liquid from the surface of the ITM blanket is also contained within the thermal shoe assembly when the thermal shoe assembly is engaged with the ITM drum. Consequently, only minimal amount of evaporated carrier liquid is released from the thermal shoe assembly into the surrounding environment.

In an alternative embodiment, the circulation blower 148 is replaced with a suctioning device, which functions as an alternative air circulating device. In this embodiment, there is a bleed opening 165 near the air intake 160 of the housing structure 158, as illustrated in FIG. 1. The bleed opening may be located at the suctioning device, the housing structure, or between the suctioning device and the housing structure. The bleed opening is configured to allow air from the suctioning device to be released, while preventing evaporated carrier liquid from being released. In operation, the suctioning device provides circulating airflow through the housing structure by taking in air from the housing structure and reintroducing the air back into the housing structure. However, due to the bleed opening, the amount of air being taken in by the suctioning device is greater than the amount of air being reintroduced by the suctioning device, which creates a pressure differential between the inside and the outside of the housing structure. Consequently, external air is drawn into the housing structure through the gap between the housing structure and the ITM blanket 144 to compensate for the differential, which prevents evaporated carrier liquid from escaping through this gap. Thus, in this embodiment, almost no evaporated carrier liquid is released into the surrounding environment.

The heating element 154 of the thermal shoe assembly 146 is a "hot shoe" structure, which can generate thermal energy. The hot shoe structure 154 includes a conduit 166 for air to flow through the structure. The conduit is connected to an input opening 168 to receive air from the circulation blower 148 and an output opening 170 to allow the air to exit the hot shoe structure. The hot shoe structure operates to heat the air received through the input opening as the air passes through the conduit of the hot shoe structure so that the heated air that exits the hot shoe structure through the output opening can heat the surface of the ITM blanket 144 to evaporate carrier liquid on the ITM blanket surface. As an example, the hot shoe structure may operate at approximately 200 degrees Celsius. However, the hot shoe structure may operate at other temperatures as long as the circulating air is heated to a sufficient temperature to evaporate the carrier liquid on the ITM blanket. The use of heated air to heat the surface of the ITM blanket is a power efficient solution to evaporate the carrier liquid on the ITM blanket surface without subjecting the ITM blanket to excessive heat that may damage the ITM blanket.

Figure 2:
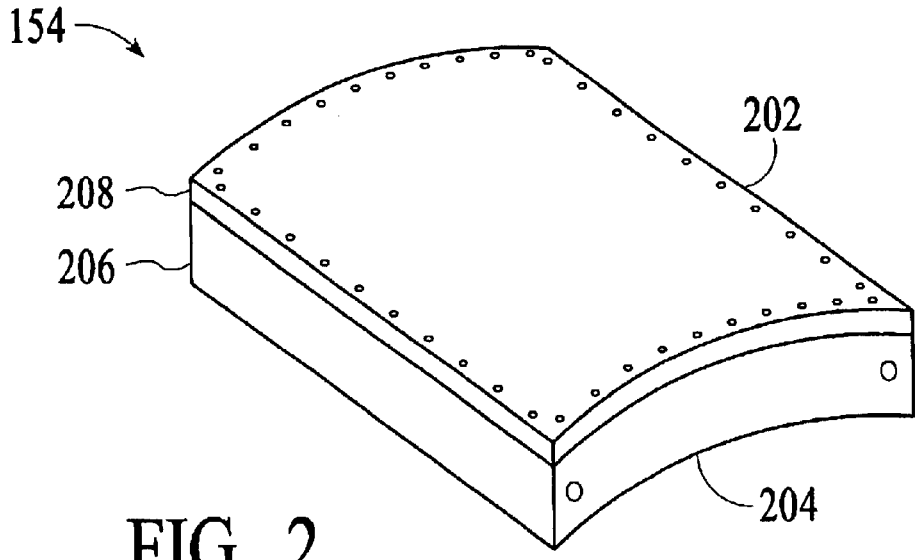
FIG. 2 is a perspective view of one embodiment of a hot shoe structure of a carrier liquid extraction system, which is included in the electrostatic imaging machine.
Figure 3:
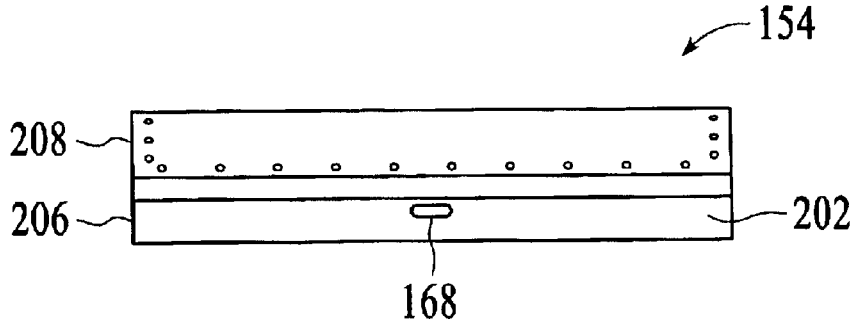
FIG. 3 is a side view of the hot shoe structure shown in FIG. 2.
Figure 4:
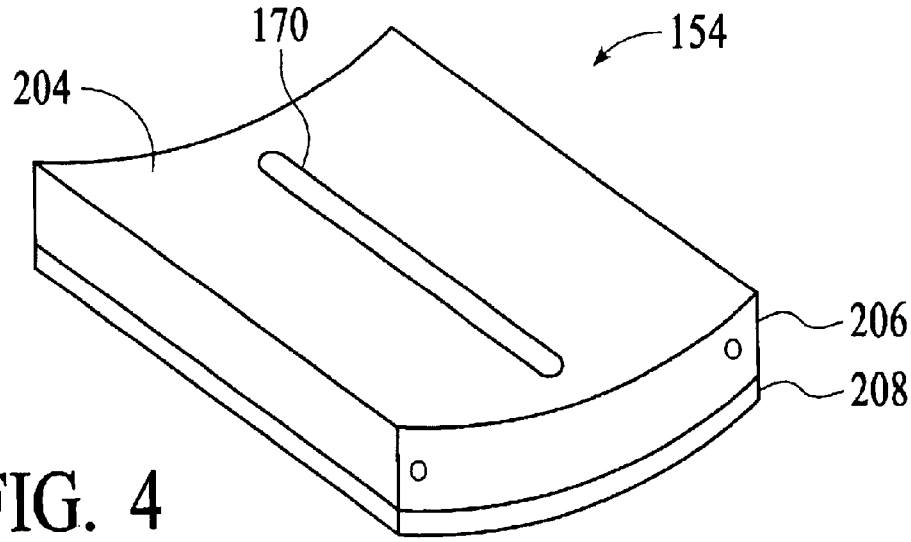
FIG. 4 is a bottom view of the hot shoe structure shown in FIG. 2.
Figure 5:
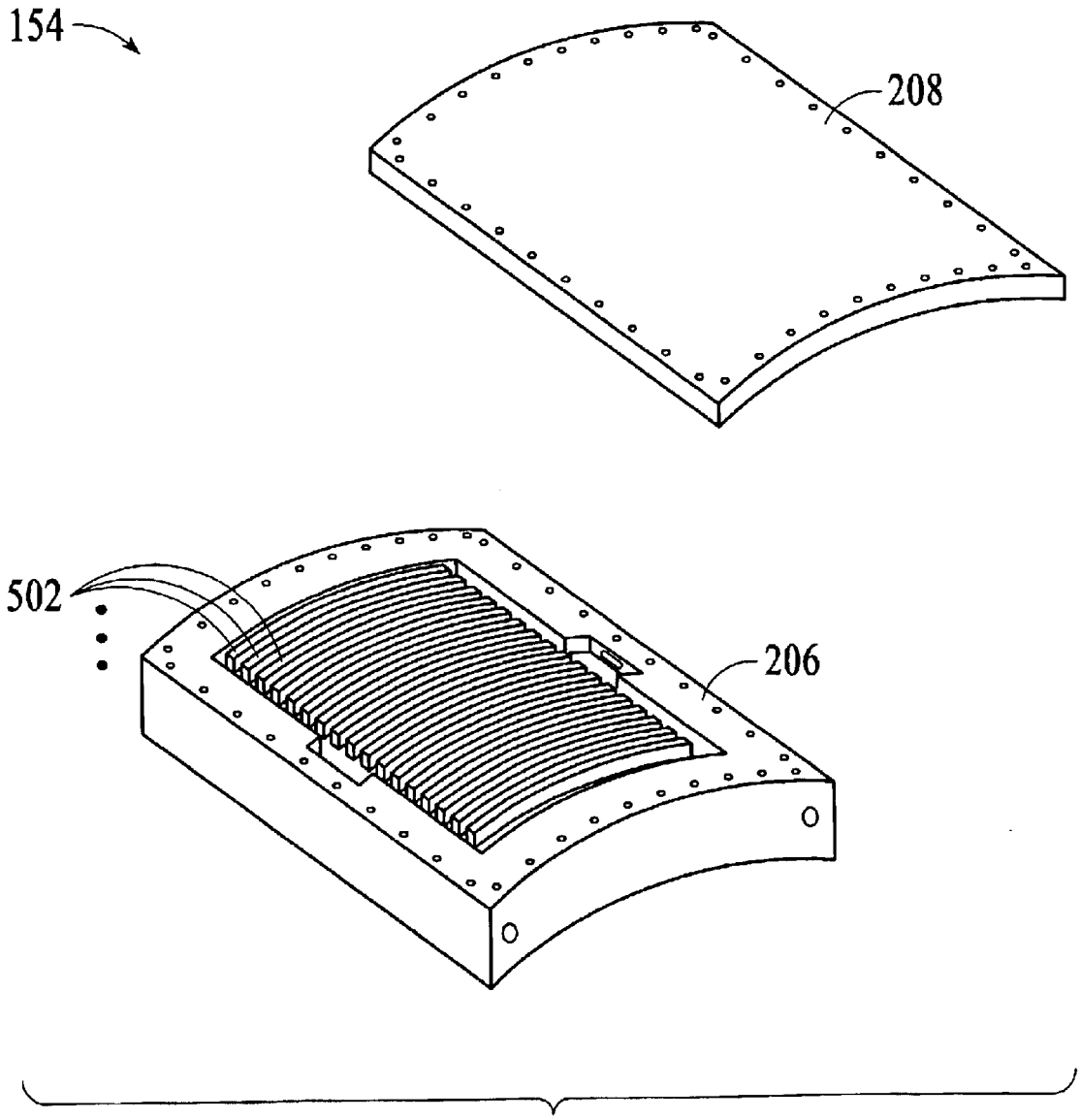
FIG. 5 is an exploded view of the hot shoe structure shown in FIG. 2.

In FIGS. 2, 3, 4 and 5, the hot shoe structure 154 of the thermal shoe assembly 146 in accordance with an exemplary configuration is shown in detail. FIG. 2 is a perspective view of the hot shoe structure. FIG. 3 is a side view of the hot shoe structure, while FIG. 4 is a bottom view of the hot shoe structure. Thus, FIGS. 3 and 4 show a side surface 202 and the bottom surface 204 of the hot shoe structure, respectively. The side surface 202 can be any side of the hot shoe structure. The bottom surface 204 of the hot shoe structure is the surface that faces the ITM drum 142 when the hot shoe structure is positioned to engage the ITM drum as part of the thermal shoe assembly 146. FIG. 5 is an exploded view of the hot shoe structure. As shown in FIGS. 2–5, the hot shoe structure is formed of a hot shoe unit 206 and a cover 208. The hot shoe unit 206 includes parallel fins 502 that create the conduit 166 of the hot shoe structure in the form of narrow airways, as shown in FIG. 5. These airways allow thermal energy to be transferred from the hot shoe structure to the air passing through the airways. That is, the air is heated by the hot shoe structure as the air passes through the airways. As shown in FIG. 3, the hot shoe unit includes the input opening 168 to receive air from the circulation blower 148. In addition, as shown in FIG. 4, the hot shoe unit includes the output opening 170 to allow the heated air to exit the hot shoe structure toward the ITM blanket 144. The output opening 170 may be a narrow slit, as illustrated in FIG. 4, so that the exiting air is applied across the surface of the ITM blanket during operation.

In an alternative configuration, the hot shoe structure 154 may not include the parallel fins 502 that form the narrow airways. In this alternative configuration, the hot shoe structure may include a large cavity where the air gets heated before exiting the hot shoe structure. In another alternative configuration, the hot shoe structure may include one or more airways that meander through the hot shoe structure from the input opening 168 to the output opening 170. Other configurations of the hot shoe structure are possible in the case in which the hot shoe structure is configured to heat passing air by directly or indirectly contacting the air for heat exchange.

Turning back to FIG. 1, the condenser 156 of the thermal shoe assembly 146 is located at the rear of the housing structure 158 such that the hot shoe structure 154 is positioned between the condenser and the ITM blanket 144 when the thermal shoe assembly is engaged with the ITM drum 142. The location of the condenser allows the heated air from the hot shoe structure, along with the evaporated carrier liquid from the ITM blanket, to be exposed to the condenser, as the circulating air flows toward the outtake 162 to be re-circulated by the circulation blower 148. In operation, the evaporated carrier liquid from the ITM blanket is condensed by the condenser and allowed to fall toward the drain 164 of the housing structure due to gravity, where the condensed carrier liquid is drained to the carrier liquid receiving receptacle 152. The condenser is operatively connected to the refrigeration unit 150, which provides coolant to the condenser so that the operating temperature of the condenser can be maintained. As an example, the operating temperature of the condenser may be few degrees above zero degrees Celsius.

Since there is significant temperature difference between the hot shoe structure 154 and the condenser 156, the thermal shoe assembly 146 may include thermal insulation between the hot shoe structure and the condenser. In the exemplary embodiment, a layer 172 of thermal insulation is attached to the surface of the hot shoe structure that is facing the condenser. Alternatively, the wall of the hot shoe structure that is facing the condenser may be made of thermally insulating material. Similarly, significant temperature difference exists between inside and outside of the thermal shoe assembly. Therefore, a layer of thermal insulation (not shown) may be attached to the housing structure 158 of the thermal shoe assembly to insulate the internal temperature of the thermal shoe assembly from the external temperature.

Alternatively, the housing structure may be made of thermally insulating material.

As described above, the thermal shoe assembly 146 is designed to be positioned in close proximity with the ITM drum 142 during operation. However, in the exemplary embodiment, the thermal shoe assembly is configured so that the entire thermal shoe assembly can be removed from the ITM drum during machine shutdown, which may be due to, for example, a paper jam. Since the hot shoe structure 154, i.e., the heat source, is part of the thermal shoe assembly, the removal of the thermal shoe assembly from the ITM drum also removes the latent heat of the hot shoe structure so that the ITM blanket 144 is not damaged by excessive heat. As an example, the thermal shoe assembly may be configured as a cam or solenoid driven device that can be moved relative to the ITM drum so that the distance between the thermal shoe assembly and the ITM drum can be increased in the event of a machine shutdown.

Figure 6:
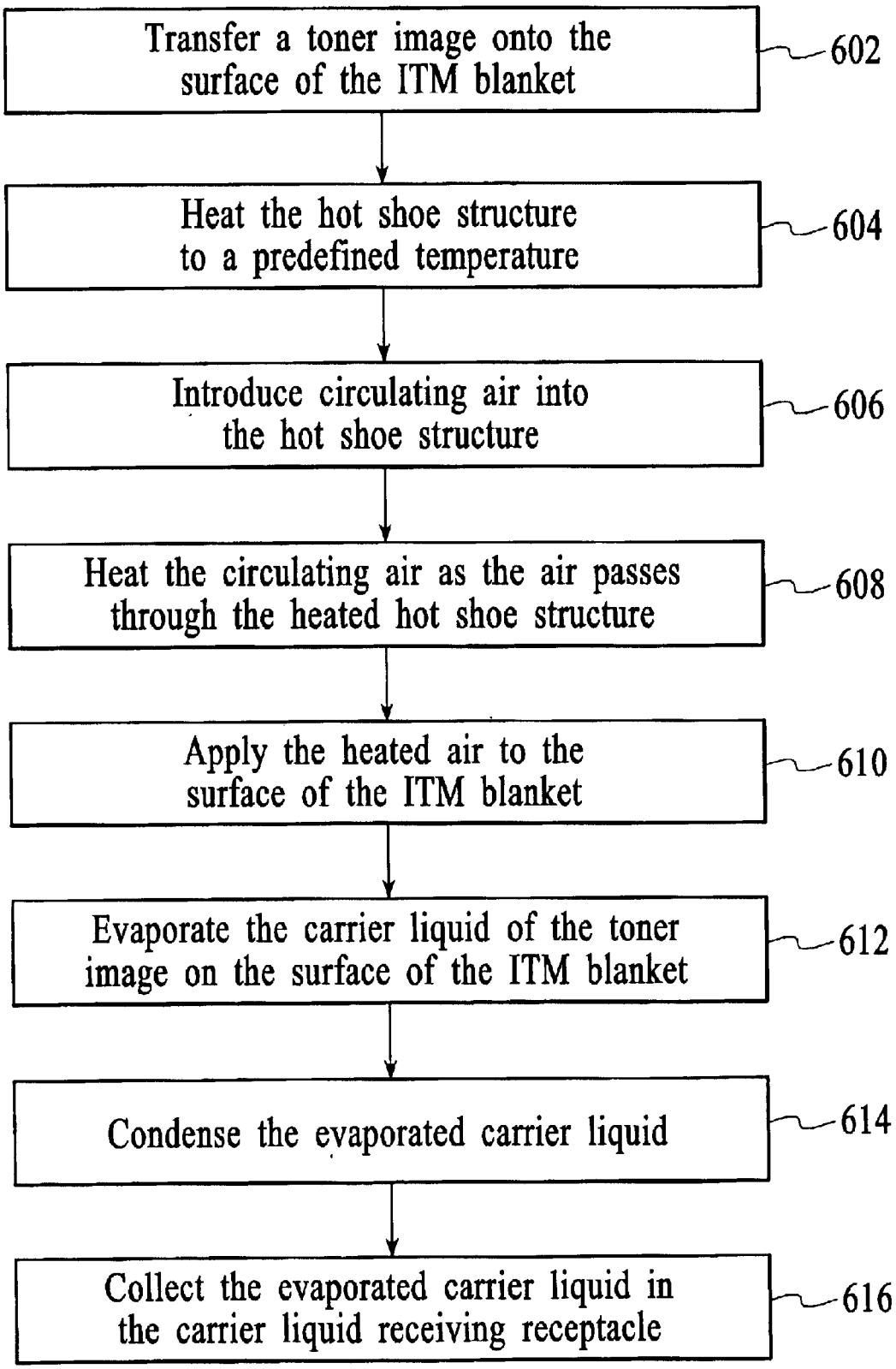
FIG. 6 is a process flow diagram of one embodiment of the operation of the carrier liquid extraction system, as part of electrostatic imaging process of the electrostatic imaging machine.

The operation of the carrier liquid extraction system 104, as part of electrostatic imaging process of the electrostatic imaging machine 100, is now described with reference to a process flow diagram of FIG. 6. At block 602, a toner image is transferred from the photoconductor surface 118 of the imaging drum 116 to the surface of the ITM blanket 144 of the ITM drum 142. The toner image is formed of one or more color liquid toners. Since each color liquid toner is a combination of concentrated toner, charge director compounds and carrier liquid, the ITM blanket receives carrier liquid when the toner image is transferred onto the surface of the ITM blanket. At block 604, the hot shoe structure 154 of the thermal shoe assembly 146 is heated to a predefined temperature, which may be approximately 200 degrees Celsius. At block 606, circulating air is introduced into the hot shoe structure by the circulation blower 148 through the air intake 160 of the thermal shoe assembly. At block 608, the circulating air is heated by the hot shoe structure as the air passes through the heated hot shoe structure. In the exemplary embodiment, the circulating air is heated as the air passes through narrow airways of the hot shoe structure to increase the heat transfer efficiency between the hot shoe structure and the circulating air. Next, at block 610, the heated air is applied to the surface of the ITM blanket. At block 612, the carrier liquid of the toner image on the surface of the ITM blanket is evaporated by the heated air. At block 614, the evaporated carrier liquid is then condensed by the condenser 156, which may be operating at near zero degrees Celsius. Next, at block 616, the condensed carrier liquid is collected in the carrier liquid receiving receptacle 152 by allowing the condensed carrier liquid to be drained through the drain 164 of the thermal shoe assembly to the carrier liquid receiving receptacle. In this fashion, the carrier liquid extraction system extracts carrier liquid from the ITM blanket during electrostatic imaging process.

Figure 7:
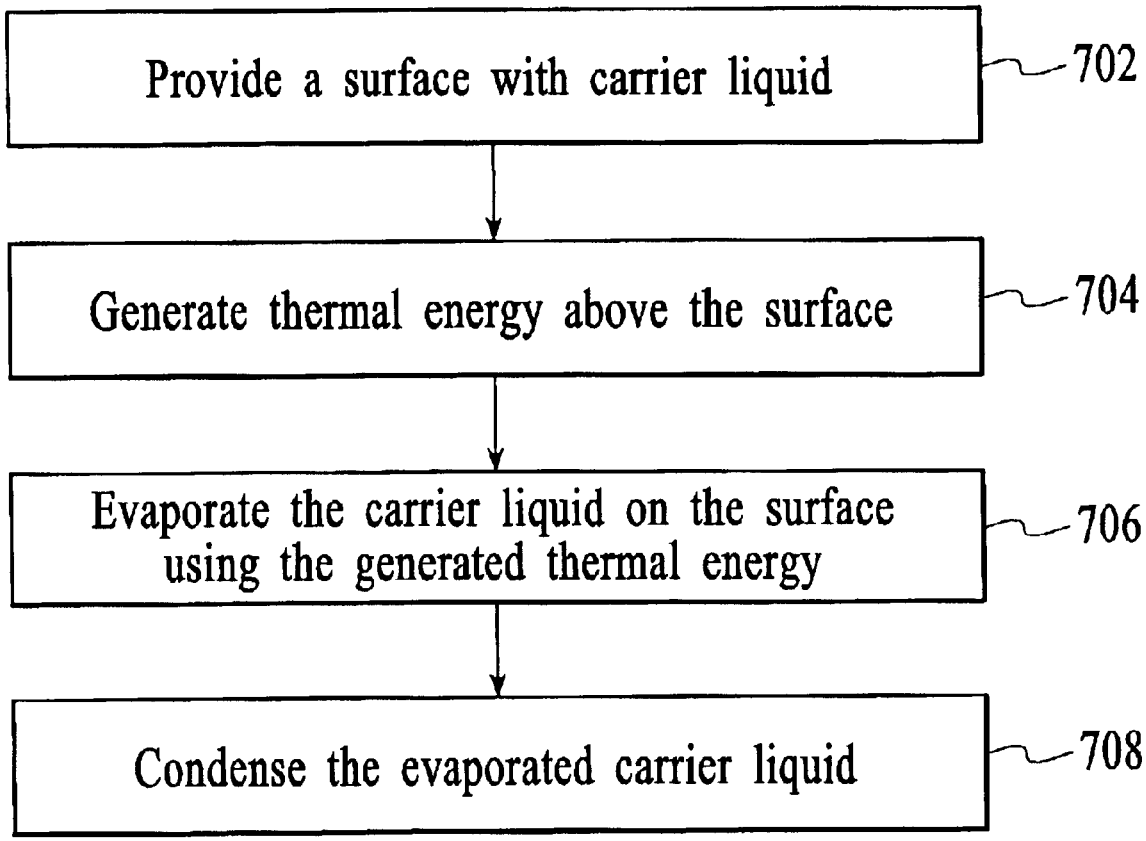
FIG. 7 is a process flow diagram of one embodiment of a method of extracting carrier liquid in accordance with the present invention.

One embodiment of a method of extracting carrier liquid in accordance with the invention is now described with reference to the process flow diagram of FIG. 7. At block 702, a surface with carrier liquid is provided. In the exemplary embodiment, the surface is the outer surface of an ITM blanket of an ITM drum, which is a component of an electrostatic imaging machine, and the carrier liquid is part of a toner image transferred onto the ITM blanket surface. Next, at block 704, thermal energy is generated above the surface. In the exemplary embodiment, the thermal energy is generated by a hot shoe structure of a thermal shoe assembly, which is part of a carrier liquid extraction system of the electrostatic imaging machine. At block 706, the carrier liquid on the surface is evaporated using the generated thermal energy. In particular, the carrier liquid is evaporated by applying air, which is heated by the hot shoe structure, to the surface of the ITM blanket. In the exemplary embodiment, the air may be heated by passing the air though one or more passages of the hot shoe structure. Next, at block 708, the evaporated carrier liquid is condensed to collect the carrier liquid. In the exemplary embodiment, the evaporated carrier liquid is condensed by a condenser that is located within a housing structure of the thermal shoe assembly. The housing structure is designed to trap most of the evaporated carrier liquid so that only minimal amount of the evaporated carrier liquid is released from the thermal shoe assembly to the surrounding environment. Consequently, more evaporated carrier liquid is condensed, which increases the amount of carrier liquid extracted from the surface with the carrier liquid.

Hence, a carrier liquid extraction system is described that is more efficient than conventional carrier liquid extraction systems because only a portion of an ITM blanket surface is heated to evaporate the carrier liquid on the ITM blanket surface, rather than the entire ITM blanket surface. In addition, the carrier liquid extraction system is designed to reduce the amount of carrier liquid released into the surrounding environment due to the substantially enclosed environment provided by a thermal shoe assembly to contain the evaporated carrier liquid. Furthermore, the configuration of the carrier liquid extraction system allows the carrier liquid extraction system to be more compact than conventional carrier liquid extraction systems because the thermal shoe assembly replaces both a suction plenum and a condensing unit, which require substantially amount of space.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A system for extracting carrier liquid comprising:

an imaging component having a surface to receive said carrier liquid;

a housing structure that can be positioned over said surface of said imaging component;

a heating element located within said housing structure, said heating element being configured to generate thermal energy, said thermal energy being used to evaporate said carrier liquid on said surface into evaporated carrier liquid; and a condenser located within said housing structure, said condenser being configured to condense said evaporated carrier liquid from said surface of said imaging component.

2. The system of claim 1 wherein said housing structure having an input to receive gaseous material, said gaseous material being used to transfer said thermal energy from said heating element to said surface of said imaging component.

3. The system of claim 1 wherein said housing structure is configured to be moved such that distance between said heating element and said surface of said imaging component can be changed.

4. The system of claim 1 wherein said heating element includes at least one passage for said gaseous material, said passage providing a path from said input of said housing structure to said surface of said imaging component.

5. The system of claim 4 wherein said heating element includes a plurality of substantially parallel passages for said gaseous material.

6. The system of claim 1 wherein said housing structure is configured to provide a substantially enclosed environment during operation to contain said evaporated carrier liquid from said surface of said imaging component.

7. The system of claim 1 wherein said heating element is positioned in said housing structure such that said heating element is situated between said surface of said imaging component and said condenser during operation.

8. The system of claim 1 wherein said housing structure includes an output opening to drain said evaporated carrier liquid from said housing structure.

9. The system of claim 1 further comprising an air circulating device connected to said housing structure and a bleeding opening located at said circulating device, at said housing structure or between said air circulating device and said housing structure.

10. A method for extracting carrier liquid comprising:

providing a surface with said carrier liquid;

generating thermal energy above said surface within a housing structure positioned over said surface;

evaporating said carrier liquid on said surface using said thermal energy to convert said carrier liquid to evaporated carrier liquid; and condensing said evaporated carrier liquid from said surface within said housing structure.

11. The method of claim 10 wherein said generating of said thermal energy includes heating a structure positioned above said surface.

12. The method of claim 11 wherein said evaporating of said carrier liquid includes heating gaseous material using said structure and applying said gaseous material to said surface.

13. The method of claim 12 wherein said heating of said gaseous material includes routing said gaseous material through at least one passage of said structure.

14. The method of claim 10 further comprising circulating gaseous material in said housing structure to promote transfer of said thermal energy and said evaporated carrier liquid.

15. The method of claim 14 further comprising creating a pressure differential between the inside and the outside of said housing structure.

16. A system for extracting carrier liquid comprising:

a housing structure configured to be positioned over a surface with said carrier liquid said housing structure including an input to receive gaseous material;

a heating element operatively connected to said housing structure, said heating element being configured to generate thermal energy over said surface to evaporate said carrier liquid on said surface into evaporated carrier liquid, said heating element including at least one passage for said gaseous material, said passage providing a path from said input of said housing structure to said surface; and a condenser operatively connected to said housing structure, said condenser being configured to condense said evaporated carrier liquid from said surface.

17. The system of claim 16 wherein said heating element and said condenser are located within said housing structure.

18. The system of claim 17 wherein said housing structure is configured to provide a substantially enclosed environment during operation to contain said evaporated carrier liquid from said surface.

19. The system of claim 17 wherein said heating element is positioned in said housing structure such that said heating element is situated between said surface and said condenser during operation.

20. The system of claim 17 wherein said housing structure is configured to be moved such that distance between said heating element and said surface can be changed.

* * * * *